US006039010A

United States Patent [19]

Hata

[11] Patent Number: 6,039,010

[45] Date of Patent: Mar. 21, 2000

[54] REVERSE ROTATION CONTROL APPARATUS FOR A TWO-CYCLE ENGINE OF A MOTOR VEHICLE

[75] Inventor: Toshiaki Hata, Hyogo, Japan

[73] Assignee: Mitsubishi Denki Kabushiki Kaisha, Tokyo, Japan

[21] Appl. No.: 09/095,936

[22] Filed: Jun. 12, 1998

[30] Foreign Application Priority Data

Feb. 2, 1998 [JP] Japan ..... 10-020899

[51] Int. Cl.[7] ..... F01L 13/02

[52] U.S. Cl. ..... 123/41 E; 123/41 R

[58] Field of Search ..... 123/41 E, 41 R, 123/406.14

[56] References Cited

U.S. PATENT DOCUMENTS 5,036,802 8/1991 D'Amours .
5,782,210 7/1998 Venturoli et al. ..... 123/41 E
5,794,574 8/1998 Bostelmann et al. ..... 123/41 E

*Primary Examiner*—Noah P. Kamen
*Assistant Examiner*—Hai Huynh
*Attorney, Agent, or Firm*—Sughrue, Mion, Zinn Macpeak & Seas, PLLC

[57] ABSTRACT

A reverse rotation control apparatus of inexpensive structure for making it possible to reverse rotation of a two-cycle engine for a motor vehicle without need for monitoring constantly engine rotation speed (rpm) while sparing gear box includes a variety of sensors for generating signals corresponding to engine operating states, and an ignition control unit (10A) for generating an ignition signal (P) on the basis of the various signals. The sensors include a rotation sensor (6) for generating a rotation signal (SG) indicating engine rotation number (Re) and a reverse rotation switch (23) for generating a reverse rotation command signal (RW). The ignition control unit (10A) includes a means for arithmetically determining on the basis of engine state a timer period (TM) over which misfire is caused to occur successively upon inputting of the reverse rotation command signal, a means for causing the misfire to occur over the timer period (TM), and a means for outputting only once an overadvanced ignition signal upon termination of the timer period (TM) which corresponds to a time taken for the engine rotation number (Re) to lower to a predetermined rotation number (ReW) due to the misfire events.

8 Claims, 4 Drawing Sheets

REVERSE ROTATION CONTROL APPARATUS FOR A TWO-CYCLE ENGINE OF A MOTOR VEHICLE

BACKGROUND OF THE INVENTION

1. Field of the Invention

The present invention generally relates to a reverse rotation control apparatus for a two-cycle engine which makes it possible to drive a motor vehicle equipped with the two-cycle engine in a rearward direction by reversing rotation of the engine. More specifically, the present invention is concerned with a reverse rotation control apparatus for a two-cycle engine of a motor vehicle which apparatus can realize a reverse rotation control with inexpensive structure.

2. Description of Related Art

In general, a four-cycle engine mounted on a motor vehicle such as a passenger car or the like is equipped with a clutch and a gear box at an output side of the engine for deriving the output power thereof by way of the clutch and the gear box.

However, in the case of small-size motor vehicles for specific purposes such as snowmobiles, all-terrain vehicles and the like, a two-cycle engine of low cost is mounted. In this conjunction, it is further noted that in the case of these motor vehicles, the space for installing the engine is limited.

Such being the circumstances, no gear box is ordinarily installed as the reverse rotation control apparatus for the two-cycle engine in the motor vehicles of the types mentioned just above, wherein the output torque of the engine is derived by way of a centrifugal-type automatic transmission constituted by a V-belt transmission.

Consequently, the motor vehicle can not be driven in other direction than the forward direction. Thus, manpower is required for moving the motor vehicle rearwards as is in the case where the motor vehicle is to be taken out from a garage or it is to be disburden from a lorry, giving rise to a problem that the motor vehicle is very inconvenient to handle.

Under the circumstances described above, it has been proposed that a clutch and a gear box are provided equally for the motor vehicle equipped with the two-cycle engine by affording a sufficient space for installation of the two-cycle engine so that the traveling directions (forward and rearward directions) of the motor vehicle can be changed over by manipulating a gear change lever, as in the case of the four-cycle engine.

For having a better understanding of the concept underlying the present invention, a hitherto-known or conventional reverse rotation control apparatus for a two-cycle engine of a motor vehicle will be reviewed in some detail.

FIG. 4 is a block diagram showing schematically and generally a configuration of a two-cycle engine system equipped with a prior art reverse rotation control apparatus for a motor vehicle in which a conventional gear box is employed.

Referring to FIG. 4, an internal combustion engine (hereinafter referred to simply as the engine) 1 driven in two cycles (i.e., two-cycle engine) is installed on a motor vehicle (not shown). The engine 1 has an output shaft 2 which rotates in one direction as indicated by an arrow, wherein a driving torque generated by the engine 1 is outputted through the medium of a clutch 3 and a gear box 4. Parenthetically, the gear box 4 is provided with a back gear train for allowing the motor vehicle to be driven backwardly or rearwardly.

Furthermore, a change lever 5 is provided in the gear box 4 for allowing a driver to manually change over gear trains.

A rotation sensor 6 for detecting the engine speed (rpm) as well as angular position of a crank shaft (or crank angle, to say in another way) of the engine is implemented in the form of an electromagnetic pickup device or the like and provided in association with the output shaft of the engine 1. A rotation signal SG derived from the output of the rotation sensor 6 is inputted to an ignition control unit 10 which may be constituted by a microprocessor or microcomputer.

The ignition control unit 10 is so designed or programmed as to arithmetically determine control timings for the engine 1 for issuing an ignition signal P on the basis of operating state information which includes not only the rotation signal SG mentioned above but also other signals derived from the outputs of other various sensors (not shown).

Further provided is an ignition coil 11 which is realized in the form of a transformer having a primary winding and a secondary winding for generating in response to the ignition signal P a secondary voltage boosted up upon interruption of the primary current, whereby a high voltage for firing is applied to a spark plug 12 of the engine 1. In this conjunction, it is to be noted that the engine 1 undergoes rotation control in a predetermined direction by controlling the ignition timing on the basis of the rotation signal SG.

In the two-cycle engine of a motor vehicle equipped with the conventional reverse rotation control apparatus such as shown in FIG. 4, the rotation output or output torque of the engine 1 can be lowered as desired through the medium of the gear box 4 while the driving direction of the motor vehicle can be changed over between the forward direction and the rearward direction with the aid of the back gear train.

However, with the arrangement shown in FIG. 4, difficulty will be encountered in securing a space around the engine 1 for affording accommodation and installation of the gear box 4. In particular, in the case of the snowmobile and the all-terrain vehicle mentioned previously, difficulty is encountered in making available an engine room for accommodating therein the engine 1 itself. Consequently, additional provision of the gear box 4 will incur remarkable increase in the manufacturing cost of these types of motor vehicles.

At this juncture, it is noted that the two-cycle engine has a feature that the crank shaft can be rotated in either in the forward or reverse direction as desired by controlling the ignition timing, differing from the four-cycle engine.

In actuality, there has been proposed a reverse rotation control apparatus for a two-cycle engine in which the feature mentioned above is made use of. By way of example, there is disclosed in U.S. Pat. No. 5,036,802 issued in 1997 such a reverse rotation control apparatus for a two-cycle engine of a motor vehicle which makes it possible to drive the motor vehicle either in the forward direction or in the rearward direction through the reverse rotation control of the engine 1 by using a centrifugal-type automatic transmission (not shown) without resorting to the use of the gear box 4.

In the case of the reverse rotation control apparatus disclosed in the U.S. Patent specification cited just above, when a driving direction of a motor vehicle equipped with a two-cycle engine is to be reversed, a driver manipulates a rotation reversing lever when the engine 1 is in a normal rotation state (corresponding to e.g. forward traveling of the motor vehicle). Then, the ignition control unit 10 lowers the rotation speed (rpm) of the engine 1 by forcibly causing misfire to take place in the engine 1. When the engine rotation speed has thus been lowered to a predetermined rotation speed (e.g. 500 rpm) which is suited for the reverse rotation control (i.e., control for reversing the rotating direction of the engine), the ignition timing at which the ignition signal P is applied is caused to advance excessively or overadvance beyond an ordinary advanced control position (which lies ordinarily within a range of 5° to 30° before the top dead center TDC in terms of crank angle (i.e., range of BTDC 5° to 30°). With the overadvance control of the ignition timing mentioned above, the ignition timing is set, for example, at BTDC 40° (i.e., at a crank angle of 40° before the top dead center), for thereby allowing the engine 1 to transit from the normal rotation state (corresponding to e.g. forward running of the motor vehicle) to the reverse rotation state (corresponding to e.g. rearward driving of the motor vehicle).

Thereafter, the ignition control unit 10 regards the reverse rotation direction as the normal rotation direction and the ignition signal P is generated at the ordinary ignition timing for sustaining continuously the reverse rotation state of the engine 1. Thus, the motor vehicle can be driven backwardly or in the reverse direction. Parenthetically, when the engine 1 is to be restored from the reverse rotation state to the normal rotation state, the control process similar to that described above is carried out by regarding the current rotating direction of the engine (i.e., the reverse rotation) as the normal rotating direction.

However, with the reverse rotation control apparatus described above, it is necessary to detect that the engine rotation number or engine speed (rpm) has been really lowered to a predetermined rotation number. To this end, it is required to monitor constantly the rotation number of the engine 1 for comparing it with a predetermined rotation number, which will increase not only the cost but also the load imposed on the ignition control unit 10, giving rise to a problem.

As is apparent from the foregoing, the reverse rotation control apparatus for the two-cycle engine for a motor vehicle suffers a problem that when the gear box 4 such as shown in FIG. 4 is employed, there arises the necessity for ensuring a space for installation of the gear box 4 around the engine 1, which will of course lead to increasing of the manufacturing cost of the engine and hence the motor vehicle.

On the other hand, in the reverse rotation control system for the engine 1 in which the engine rotation number is once lowered and then the ignition timing is overadvanced, as is disclosed in U.S. Pat. No. 5,036,802, there arises the necessity for monitoring the engine rotation speed (rpm) up to a time point immediately before the start of the overadvanced ignition timing control in order to decide that the engine rotation speed has decreased to the predetermined level suited for the rotation reversing control, increasing ultimately not only the cost of the engine system but also the burden imposed on the ignition control unit 10, giving rise to another problem.

SUMMARY OF THE INVENTION

In the light of the state of the art described above, it is an object of the present invention to provide a reverse rotation control apparatus for a two-cycle engine of a motor vehicle which apparatus can be implemented inexpensively by making it possible to reverse the rotation of the engine without need for monitoring constantly the engine rotation number while sparing the gear box.

In view of the above and other objects which will become apparent as the description proceeds, there is provided according to a general aspect of the present invention a reverse rotation control apparatus for a two-cycle engine mounted on a motor vehicle and driven in two cycles, which apparatus includes a variety of sensors for generating a variety of information signals in correspondence to engine operating states, and an ignition control unit for generating an ignition signal for the engine on the basis of the variety of information signals. The variety of sensors include a rotation sensor for generating a rotation signal corresponding to rotation number of the engine and a reverse rotation switch for generating a reverse rotation command signal commanding changing over of engine rotation to a reverse rotation. The ignition control unit includes a timer period arithmetic means for arithmetically determining on the basis of the engine operating state a timer period over which misfiring is caused to occur successively in response to inputting of the reverse rotation command signal, a misfire control means for causing misfire events to occur successively over the timer period, and an overadvanced ignition signal generating means for outputting only once an ignition signal at a timing overadvanced relative to an ordinary advanced ignition timing upon termination of the timer period. The timer period represents a time taken for the engine rotation number to lower to a predetermined engine rotation number suited for effectuating engine rotation reversing control due to occurrence of the misfire events, and the predetermined rotation number is set at a value smaller than an idling rotation number of the engine.

By virtue of the arrangement described above, there can be realized inexpensively the reverse rotation control apparatus for a two-cycle engine of a motor vehicle.

In a preferred mode for carrying out the invention, the ignition control unit may further include a reverse rotation condition decision means for making decision upon inputting of the reverse rotation command signal as to whether or not the engine operating state satisfies reverse rotation enabling conditions, and wherein operation of the misfire control means is started only when the reverse rotation enabling conditions are satisfied.

With the arrangement described above, enhanced maneuverability of the motor vehicle equipped with the reverse rotation control apparatus can be ensured.

In another preferred mode for carrying out the invention, the various sensors may further include a brake switch for generating a brake signal upon braking operation and an idle switch for generating an idle signal when an acceleration pedal is released, wherein the reverse rotation enabling condition decision means may be so designed as to determine that the reverse rotation enabling conditions are met when the engine rotation number corresponds to an idling rotation number and when both of the brake signal and the idle signal are inputted.

By virtue of the arrangement described above, maneuverability of the motor vehicle can equally be enhanced.

In yet another preferred mode for carrying out the invention, the various sensors may further include a temperature sensor for outputting a signal indicating temperature information concerning temperature of the engine, wherein the timer period arithmetic means may be so designed as to determine arithmetically the timer period on the basis of the rotation signal and the temperature information.

By virtue of the arrangement described above, the reverse rotation control can be positively protected against failure.

In still another preferred mode for carrying out the invention, the timer period arithmetic means may be so designed as to determine arithmetically the timer period on the basis of the rotation number of the engine prevailing at a time point when the misfire control means is activated and a lowering rate of the rotation number over a time span immediately following the activation of the misfire control means.

With the arrangement mentioned above, the timer period of concern can be set with high reliability, whereby the rotation reversing control can be protected against failure more positively.

In a further preferred mode for carrying out the invention, the ignition control unit may be so implemented as to include an ordinary ignition means for outputting an ordinary ignition signal in succession to an overadvanced ignition signal generated by the overadvanced ignition signal generating means, a reverse rotation decision means for deciding whether or not the engine is in a reverse rotation state at a time point when the normal ignition signal is outputted, and a reverse rotation repeating means for executing repetitively reverse rotation control processing for the engine until the reverse rotation state is decided.

By virtue of the arrangement described above, failure of the reverse rotation control can further be avoided.

In yet further preferred mode for carrying out the invention, the reverse rotation repeating means may include a counter means for counting a number of times the reverse rotation control processing is repeated. In that case, the reverse rotation control processing can be terminated at a time point when the repeating number has attained a predetermined rotation number.

Owing to the arrangement described above, repetitive execution of the reverse rotation control in vain can be avoided.

In yet further preferred mode for carrying out the invention, the reverse rotation control apparatus mentioned above may further include a normal rotation indicating lamp and a reverse rotation indicating lamp, wherein both the lamps are driven under the control of the ignition control unit such that the normal rotation indicating lamp is energized only when the engine is rotating in the normal direction, while the reverse rotation indicating lamp is lit only when the engine is rotating in the reverse direction.

With the arrangement described above, the driver of the motor vehicle can get visibly recognizable information as to the current state of the motor vehicle.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
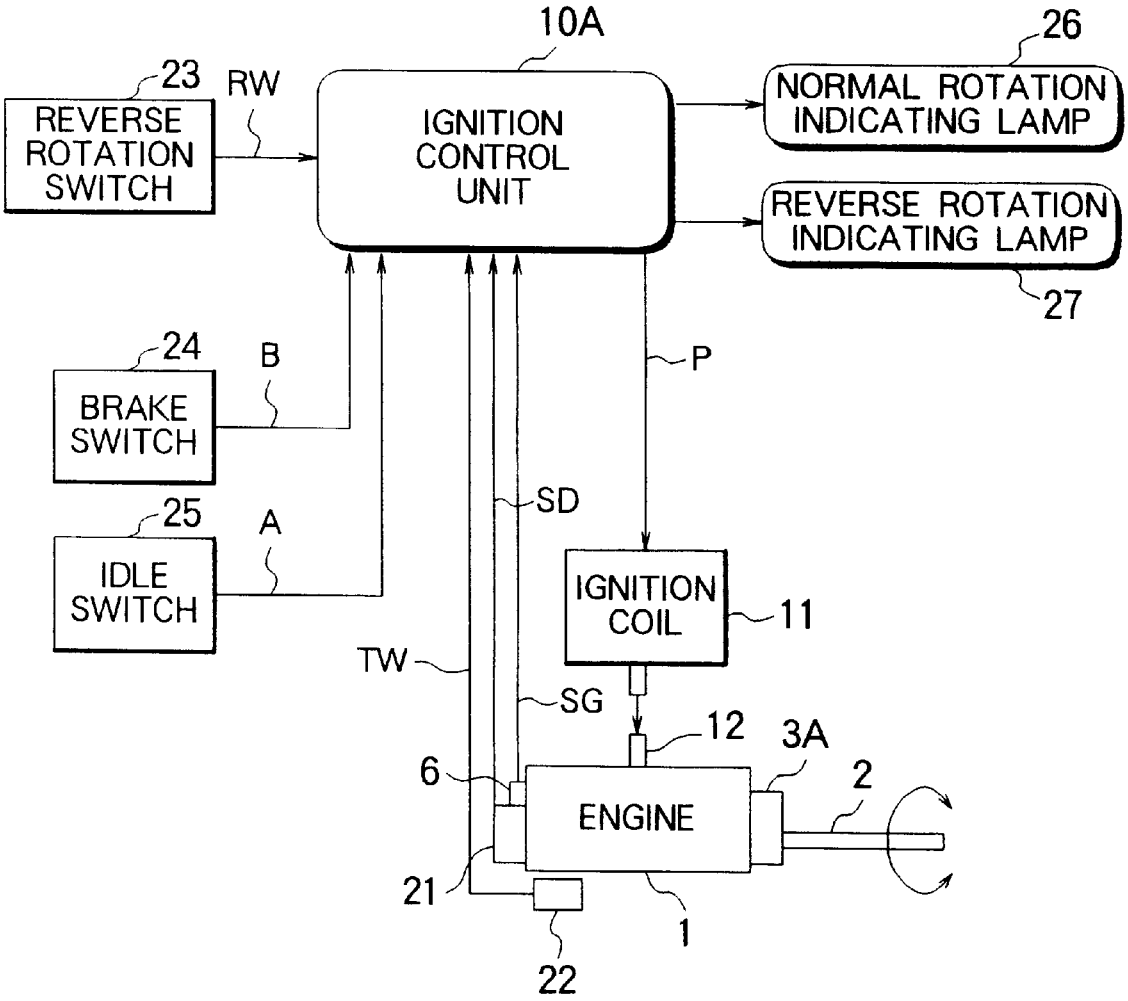
FIG. 1 is a block diagram showing generally an arrangement of a reverse rotation control apparatus for a two-cycle engine of a motor vehicle according to an embodiment of the present invention.

The present invention will be described in detail in conjunction with what is presently considered as preferred or typical embodiments thereof by reference to the drawings. In the following description, like reference characters designate like or corresponding parts throughout the several views. At this juncture, it should be added that although the subject matter of the invention is expressed as the reverse rotation control of a two-cycle engine, it may equally be expressed as the rotation reversing control of the engine.

Embodiment 1

Now, description will be made of a reverse rotation control apparatus (or rotation reversing control apparatus, to say in another way) according to an embodiment of the present invention by reference to FIG. 1. FIG. 1 is a functional block diagram showing generally an arrangement of the reverse rotation control apparatus and a two-cycle engine system according to the first embodiment of the invention. In the figure, components like as or equivalent to those described hereinbefore by reference to FIG. 4 are designated by like reference characters and repeated description in detail of these components is omitted.

Figure 4:
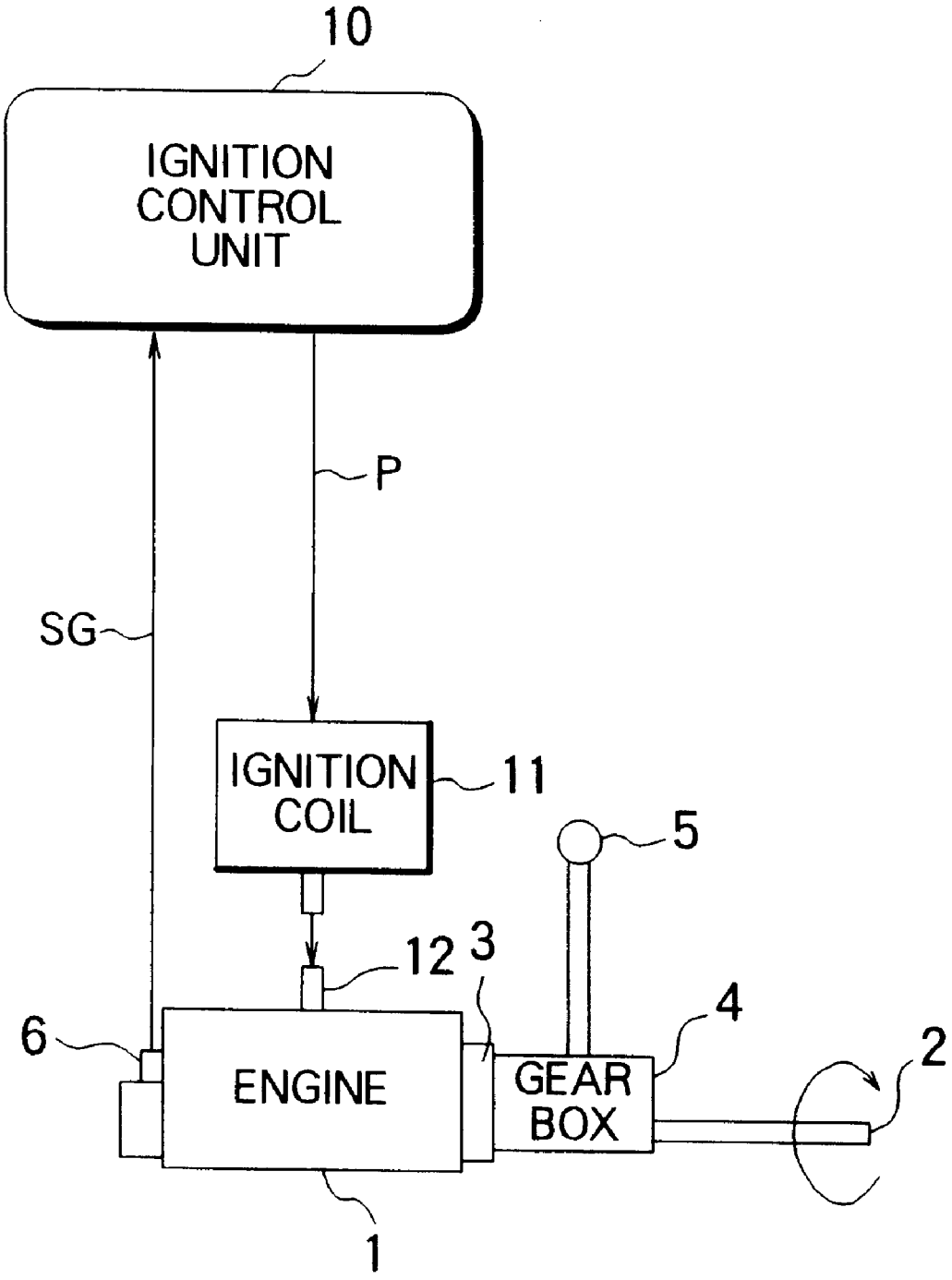
FIG. 4 is a block diagram showing schematically and generally a configuration of a two-cycle engine system equipped with a prior art reverse rotation control apparatus a motor vehicle in which a conventional gear box is employed.

Referring to FIG. 1, an ignition control unit 10A substantially corresponds to the ignition control unit 10 described hereinbefore by reference to FIG. 4 with exception that a control operation executing program differs in several respects.

Further, a centrifugal automatic transmission 3A corresponds to the clutch 3 described hereinbefore and it is implemented in the form of a conventional V-belt transmission. The engine 1 has an output shaft 2 which can be rotated exchangeably in either a forward direction or a reverse direction, as is indicated by a double arrow.

A rotating direction sensor 21 is provided in association with a rotatable shaft of the engine 1 for generating a rotating direction signal SD which indicates the rotating direction of the engine 1. Further provided is a temperature sensor 22 which is designed for detecting temperature of cooling water of the engine 1 or that of the engine wall. Hereinafter, this temperature will be referred to as water temperature only for convenience of description. The temperature sensor 22 outputs a water temperature signal TW which can be used as the engine temperature information.

Further provided is a reverse rotation switch 23 which may be constituted by a push button switch for generating a reverse rotation command signal RW indicating a reverse rotation command in response to manipulation of the push button switch by an operator or driver.

A brake switch 24 is so arranged as to output a brake signal B in response to brake applying operation performed by the driver. On the other hand, an idle switch 25 is so arranged as to output an idle signal A indicating an idling operation state of the engine 1 (the state in which an acceleration pedal is released) in response to acceleration pedal releasing operation performed by the driver (i.e., operation for closing fully a throttle valve disposed within an intake pipe of the engine).

The rotating direction sensor 21, the water temperature sensor 22, the reverse rotation switch 23, the brake switch 24 and the idle switch 25 mentioned above constitute together with the rotation sensor 6 a set of the so-called various sensors which generate or output various information signals corresponding to the operating state of the engine 1. The rotating direction signal SD, the water temperature signal TW, the reverse rotation command signal RW, the brake signal B and the idle signal A outputted from the so-called various sensors are supplied as the operating state information to the ignition control unit 10A together with the rotation signal SG outputted from the rotation sensor 6.

Parenthetically, it goes without saying that a starter switch for starting the engine 1 is provided although it is not shown in FIG. 1 and thus an engine start signal is also inputted to the ignition control unit 10A upon starting of the engine 1.

In the ignition control unit 10A, the rotation signal SG, the brake signal B, the idle signal A and the engine start signal are utilized as the information indicative of the conditions for starting the control for reversing the rotation (i.e., the reverse rotation control or rotation reversing control) of the engine 1.

More specifically, the reverse rotation control should not be executed in the state in which the motor vehicle is cruising (running steadily). Accordingly, the ignition control unit 10A is so designed or programmed that the reverse rotation control can not be executed even when the reverse rotation switch 23 is closed with the reverse rotation command signal RW being inputted to the ignition control unit 10A unless the conditions for stopping the engine 1 (hereinafter also referred to also as the engine stopping conditions) are satisfied.

There are provided additionally a normal rotation indicating lamp 26 and a reverse rotation indicating lamp 27 which are driven or electrically energized under the control of the ignition control unit 10A for indicating to the driver the direction in which the engine 1 is rotating currently (i.e., normal rotation or reverse rotation) and hence the traveling direction of the motor vehicle (i.e., forward or rearward). The normal rotation indicating lamp 26 is energized only when the engine is rotating in the normal direction (usually corresponding to the forward traveling direction of the motor vehicle), while the reverse rotation indicating lamp 27 is lit only when the engine is rotating in the reverse direction.

Figure 2:
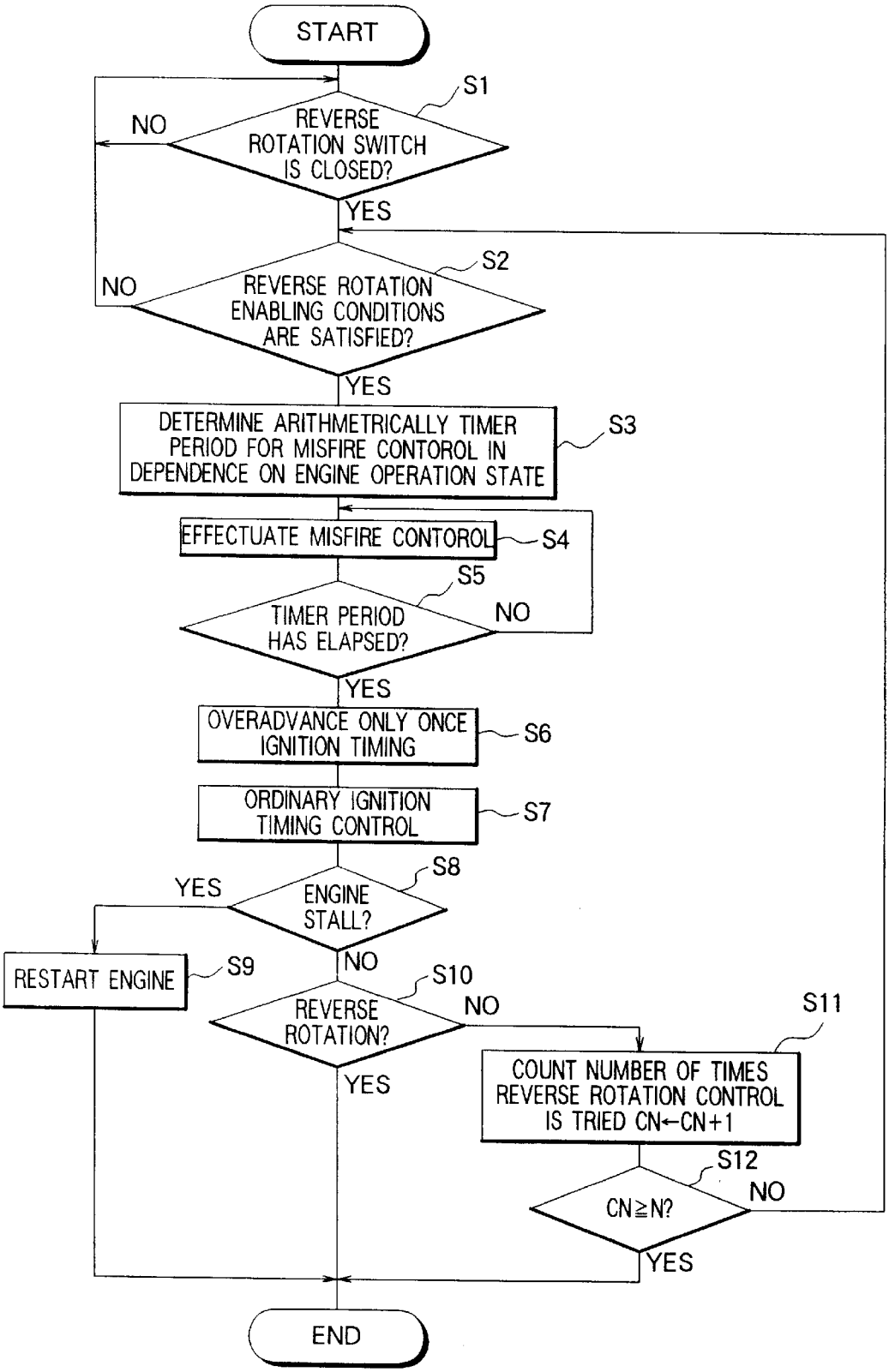
FIG. 2 is a flow chart for illustrating a reverse rotation control procedure executed by an ignition control unit incorporated in the apparatus shown in FIG. 1.
Figure 3:
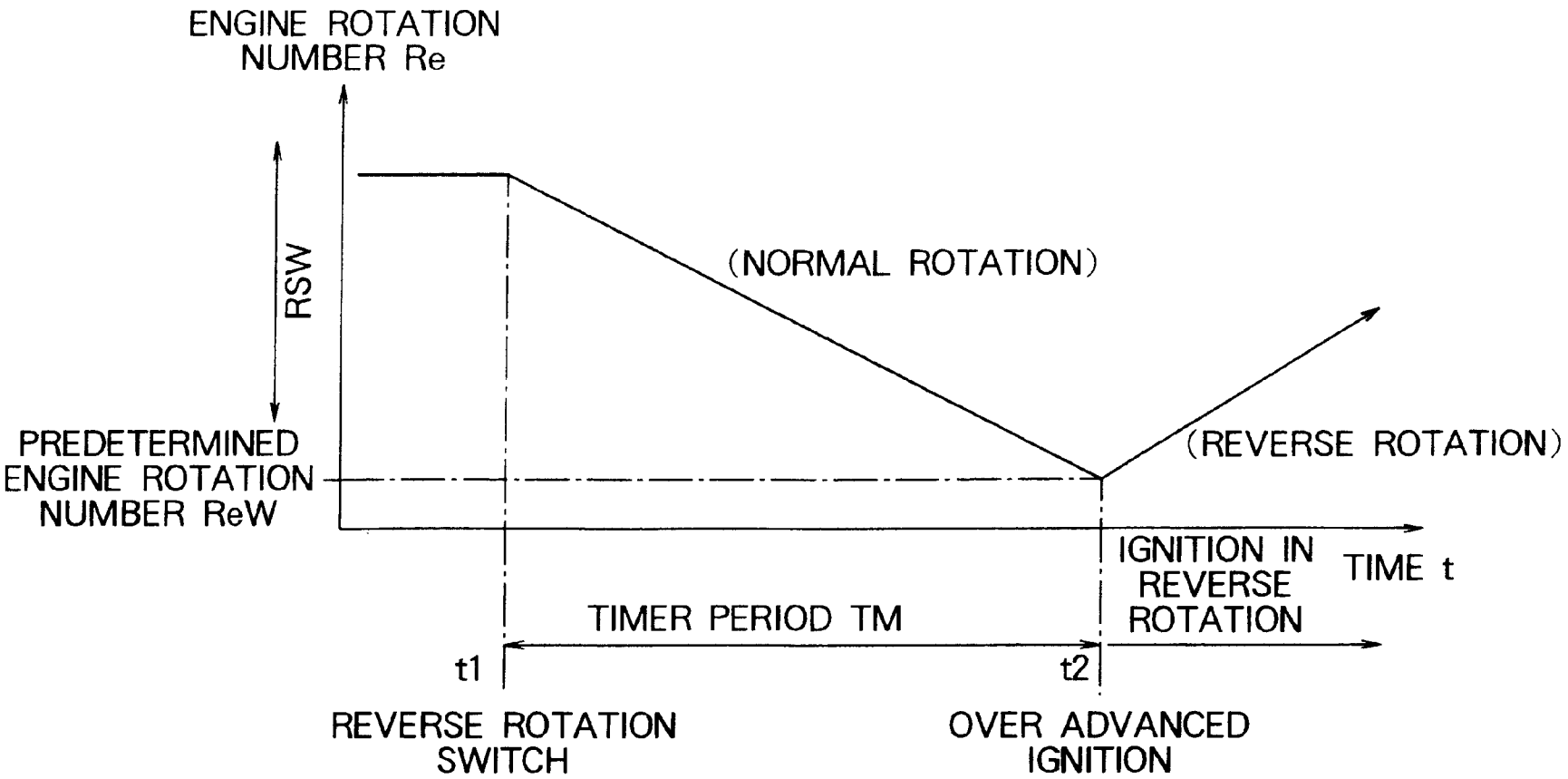
FIG. 3 is a timing chart for illustrating operation of a reverse rotation control according to the invention.

Next, referring to FIGS. 2 and 3, description will be directed to operation of the reverse rotation control apparatus (or rotation reversing control apparatus) according to the instant embodiment of the invention. As elucidated hereinbefore, rotation of the two-cycle engine 1 can be reversed by controlling the ignition timing.

More specifically, the engine rotation number Re is lowered to the predetermined engine rotation number ReW (ca. 500 rpm) at which the output torque is relatively low, and ignition or firing is performed at a crank angle position advanced relative to the normal ignition timing during stroke of the piston of the engine 1 toward the top dead center TDC, as a result of which a repulsing force is produced due to the explosion of combustible mixture within the engine cylinder. Thus, the reverse rotation of the engine can be triggered. Once the reverse rotation has been realized, the normal or ordinary ignition timing control is resumed for sustaining continuously the reverse rotation state as desired by the driver.

In that case, the ignition control unit 10A carries out basic operations mentioned below. The crank angle position (i.e., angular position of the crank shaft) and the rotation number Re of the engine 1 are detected on the basis of the rotation signal SG while detecting the rotating direction of the engine 1 on the basis of the rotating direction signal SD, for thereby controlling the ignition timing in the forward rotation operation mode or in the reverse rotation operation mode.

Further, the ignition control unit 10A executes an intrinsic control operation mentioned below.

Namely, in response to the rotation reverse control command, the ignition control apparatus 10A executes a misfire control for lowering the engine rotation speed (rpm) Re by predicting arithmetically a timer period TM (temporal period set at a timer for which the misfire control is to be continued) from map data on the basis of the engine rotation number Re and the engine temperature corresponding to the water temperature TW mentioned previously, only when the conditions for enabling the rotation reversing control to be started are satisfied.

FIG. 2 is a flow chart for illustrating a reverse rotation control (or rotation reversing control) procedure or processing executed by the ignition control unit 10A. More specifically, this flow chart illustrates a processing procedure involved for changing over the engine rotation from the normal rotation mode to the reverse rotation mode. In this conjunction, it should be mentioned that restoration of the engine 1 from the reverse rotation mode to the normal rotation mode can equally be realized by resorting to the essentially same procedure. Further, FIG. 3 is a timing chart for illustrating change of the engine rotation number Re taking place in the course of the rotation reversing control process.

It is presumed that upon starting of the engine operation, the engine 1 is rotated in the forward direction (also referred to as the normal direction) under the control of the ignition control unit 10A. Subsequently, the normal or ordinal ignition control is performed continuously in conformance with the prevailing engine operating state by arithmetically determining the ignition timing.

Now, let's assume that the driver manipulates the reverse rotation switch 23. Then, the reverse rotation command signal RW (which may also be referred to as the rotation reversing command signal) is then inputted to the ignition control unit 10A.

Referring to FIG. 2, the ignition control unit 10A monitors constantly whether the reverse rotation switch 23 is turned on (closed) or not (step S1). The rotation command signal RW is detected within a detectable range RSW of the engine rotation number Re (see FIG. 3).

When the reverse rotation command signal RW is inputted to the ignition control unit 10A, it is then decided in the step S1 that the reverse rotation switch 23 is closed (i.e., the decision step S1 results in affirmation or "YES"). Subsequently, in a succeeding step S2, decision is made as to whether or not the engine operating state at this time point satisfies the reverse rotation enabling conditions.

As the conditions for enabling or validating the reverse rotation of the engine 1, there may be mentioned such conditions that the engine rotation number Re is lower than that in the ordinary running state (e.g. lower than 2000 rpm inclusive), both the idle signal A and the brake signal B are inputted, the time lapse from the start of the engine 1 amounts to at least 2 seconds and others.

When it is decided in the step S2 that the reverse rotation enabling conditions are not met (i.e., when the decision step S2 results in negation or "NO"), the reverse rotation command signal RW being currently inputted is neglected, whereupon the processing resumes the step S1.

To this end, the ignition control unit 10A may be so programmed as not to start the reverse rotation control unless any one of the following conditions is met, i.e., the conditions that the engine rotation number Re determined on the basis of the rotation signal SG lies within a predetermined range of the idling rotation number (800 rpm to 2000 rpm), the brake signal B is inputted by way of the brake switch 24 due to depression of a brake pedal by the driver and the idle signal A of on-state is inputted by way of the idle switch 25 with the acceleration pedal being released (with the throttle valve being fully closed). If any one of these conditions is not satisfied, the reverse rotation control is inhibited from being started because then the stability can not be ensured in driving the motor vehicle. In this way, maneuverability of the motor vehicle can be projected against degradation.

On the other hand, when decision is made in the step S2 that the reverse rotation enabling conditions are met (i.e., when the decision step S2 results in "YES"), the ignition control unit 10A puts into operation the reverse rotation control or rotation reversing control.

By way of example, when the engine rotation number Re in the normal rotation mode (forward driving mode of the motor vehicle) is 1200 rpm after lapse of 2 seconds or more from the engine start (corresponding to the idle state) and when both the idle signal A and the brake signal B are inputted, the reverse rotation control is started in response to the input of the reverse rotation command signal RW.

At first, the timer period TM over which the misfire control is to be continued is arithmetically determined from map data stored previously in dependence on the engine operating state prevailing at the time point when the reverse rotation switch 23 is turned on (step S3), whereupon the misfire control is started in a step S4.

To this end, the ignition signal P which is generated at the ordinary advanced ignition timing in the steady operation state of the engine (e.g. ignition timing corresponding to BTDC 30°) is cut or invalidated in order to sustain the misfire occurring state over the timer period TM as determined.

In this conjunction, it is to be noted that data for the timer period TM is previously stored in a memory incorporated in the ignition control unit 10A in the form of map data, and thus the timer period TM is determined from the map data as the predicted or estimated time which will be required for the engine speed to lower to a predetermined engine rotation number ReW (600 rpm to 400 rpm) optimal for reversing the rotation of the engine while taking into account the engine rotation number Re and the temperature (water temperature) TW prevailing when the rotation reversing control process is started.

Thus, the timer period TM is set relatively longer when the engine rotation number Re in the initial phase is high, because a relative long time will then be taken for the rotation speed of the engine to decrease to the predetermined rotation speed. Similarly, the timer period TM is set to be relatively longer when the engine temperature (water temperature TW) in the initial phase is high because the engine 1 is then in the sufficiently warmed-up state.

In this way, the timer period TM (map data value) is corrected in consideration of the engine state (indicated by the temperature information derived from the output of the temperature sensor 22) to be thereby set optimal for lowering the engine rotation speed (rpm) to the predetermined value for validating the rotation reversing ignition timing control. Thus, the engine rotation reversing control operation can be effectuated essentially without fail.

So long as the misfire control (step S4) is being effected, the engine rotation number Re continues to lower, as can be seen in FIG. 3.

In that case, the ignition control unit 10A monitors constantly the engine rotation number Re for making decision whether the timer period TM has lapsed or not (step S5) and continues the misfire control until the timer period TM has lapsed in the step S4.

More specifically, the misfire control for lowering the engine rotation number Re before starting to reverse the rotation of the engine is performed consecutively over the timer period TM from a time point t1 to a time point t2 (see FIG. 3), whereby the engine rotation number Re is decreased to the predetermined engine rotation number ReW suited for realizing the overadvanced ignition timing.

When it is decided in the step S5 shown in FIG. 2 that the timer period TM has lapsed from the start of the misfire control (step S4) (i.e., when the decision step S5 results in "YES"), the ignition control unit 10A generates only once the ignition signal P set at an overadvanced crank angle (within a range of BTDC 30° to BTDC 60° or so) relative to the ordinary advanced ignition timing (which lies usually within a range of BTDC 5° to BTDC 30°) (step S6).

At the time point t2 at which the timer period TM for the misfire control has elapsed (see FIG. 3), the torque of the crank shaft of the engine 1 may be regarded to be sufficiently lowered with the engine rotation number Re having decreased to the predetermined engine rotation number ReW.

By causing the firing of combustible mixture to take place within the engine cylinder only once at the overadvanced ignition timing (e.g. in a range of BTDC 30° to BTDC 60°) during the piston stroke toward the top dead center TDC, reverse rotation of the engine is started, being triggered by explosion occurred within the cylinder.

Once the reverse rotation has been started, then the engine control is performed in continuation through the ordinary ignition timing control by regarding the reverse rotation mode as the normal rotation mode (step S7). Consequently, the engine rotation number Re of the engine 1 increases in the reverse rotation mode as well, as can be seen in FIG. 3. It should however be mentioned that rotation of the engine 1 can not always be reversed in the step S7. Accordingly, in succession to the step S7, the ignition control unit 10A makes decision in a step S8 as to whether the stall of the engine 1 takes place or not. When the stall occurs (i.e., when the result of the decision step S7 is "YES"), the engine 1 is restarted in a step S9, whereupon the processing illustrated in FIG. 2 comes to an end.

On the other hand, when it is decided in the step S8 that no engine stall occurs (i.e., when the output of the decision step S8 is "NO"), then a step S10 is executed for deciding whether or not the engine 1 is rotating in the reverse direction on the basis of the rotation signal SG (crank angle signal) and the rotating direction signal SD.

When it is decided in the step S10 that the engine is currently rotating in the reverse direction (i.e., when the output of the step S10 is "YES"), the ignition control unit 10A deenergizes the normal rotation indicating lamp 26 while lighting the reverse rotation indicating lamp 27 to inform the driver that the rearward driving of the motor vehicle is now validated, whereupon the processing illustrated in FIG. 2 comes to an end.

On the other hand, when it is decided in the step S10 that the engine 1 is rotating in the normal or forward direction because of failure in reversing the engine rotation (i.e., when the decision step S10 results in "NO"), this means that the engine 1 is rotating in the ordinarily normal direction (forward direction). Thus, there arises necessity of executing again the reverse rotation control processing.

In that case, the ignition control unit 10A counts the number of the times the reverse rotation control is tried by incrementing a corresponding counter value CN in a step S11 and makes decision as to whether or not the counter value CN has reached a predetermined value N (e.g. three) in a step S12.

When it is decided in the step S12 that the reverse rotation control processing was repeated a predetermined number of times N and that the counter value CN is equal to or greater than the predetermined value N (i.e., when the answer of the step S11 is "YES"), then the processing shown in FIG. 2 is terminated by regarding that attempt for realization of the reverse rotation control will end in vain. In this way, useless repetition of the reverse rotation control validating process is prevented.

As is apparent from the above, when the reverse rotation of the engine can not be realized within the predetermined number (N) of repetitions, the ordinary engine control in the forward driving direction is restored without repeating the attempt for realizing the reverse rotation control in vain, whereon the ignition control unit 10A is reset to the state waiting for the reverse rotation command issued upon actuation of the reverse rotation switch 23.

When the decision in the step S12 results in that CN<N (i.e., when the step S11 results in negation or "NO"), the reverse rotation condition decision step S2 is resumed, whereon attempt for enabling or validating the reverse rotation control described above is repeated. The number of times the reverse rotation control processing can be tried may be set to e.g. three. In this manner, validation of the reverse rotation control is automatically tried with the ignition timing having been retarded to the ordinary ignition timing.

At this juncture, it should be mentioned that the conditions for enabling the reverse rotation control are checked even in the course of the reverse rotation control so that the reverse rotation control processing can be reset immediately when any one of the previously mentioned conditions for enabling the reverse rotation control is not satisfied due to releasing of the brake and/or actuation of the acceleration pedal, whereby the ordinary engine control in the forward direction is resumed.

The ignition control unit 10A performs the control for preventing the runaway of operation of the centrifugal automatic transmission 3A and validates the ordinary control when the conditions for changing over the reverse rotation to the forward or normal rotation are satisfied. The changeover of the engine operation from the reverse rotation control state (rearward driving of the motor vehicle) to the normal rotation state (forward driving of the motor vehicle) can be realized by executing the control processing procedure illustrated in FIG. 2 by regarding the reverse rotation mode prevailing currently as the normal mode.

As will now be understood from the above description, the time point (predetermined rotation number ReW) suited for applying the ignition signal P at the overadvanced ignition timing is determined by the timer period TM (the time expected to be taken for the engine rotation speed to lower to the engine rotation number suited for validating the rotation reversing control) which in turn can be arithmetically determined on the basis of the engine operation state (water temperature TW and the engine rotation number Re) prevailing when the misfire control is started. Thus, it is unnecessary to monitor constantly the engine rotation number Re during the misfire control.

At the end of the timer period TM (the time point for changing over the rotation of the engine in the reverse or backward direction), the ignition signal (pulse) P is applied at the overadvanced ignition timing. In this manner, the overadvanced ignition control can be realized at the predetermined engine rotation number ReW suited for reversing the rotation of the engine.

As is apparent from the foregoing, according to the teachings of the present invention, the reverse rotation of the engine can be realized by employing the inexpensive centrifugal-type automatic transmission 3A without resorting to the use of the expensive gear box 4 (see FIG. 4), and thus the peripheral space of the engine 1 can be reduced, which means that the whole engine system can be implemented inexpensively in a small size. Besides, power as well as maneuverability of the motor vehicle equipped with the engine according to the invention can be effectively enhanced because of possibility of implementing the engine 1 in light weight.

Because the timer period TM for the misfire control is previously determined arithmetically or predicted on the basis of the engine operation state prevailing when the rotation reversing control is started, the engine rotation number Re can be decreased to the predetermined engine rotation number ReW at the end of the timer period with high reliability.

Furthermore, by setting the conditions such as the engine rotation number corresponding to the idling state and others for allowing the misfiring process to be started for enabling the reverse rotation control, the reverse rotation control processing can be started only when the reverse rotation enabling conditions are met. Besides, upon occurrence of failure in reversing the rotation of the engine 1, the reverse rotation control processing can be repeated, which contributes to enhancing the reliability in reversing the engine rotation.

Additionally, because the ignition control unit 10A is so arranged as to light the reverse rotation indicating lamp 27 while deenergizing the normal rotation indicating lamp 26 when the engine rotation is reversed, information indicating that the motor vehicle can be driven rearwardly or backwardly is made available for the driver.

Embodiment 2

In the case of the reverse rotation control apparatus according to the first embodiment of the invention, the timer period TM is arithmetically determined by monitoring the engine rotation number Re at the time the misfire process is started as well as the water temperature TW without monitoring actually the engine rotation number Re at the overadvanced ignition timing. By contrast, in the reverse rotation control apparatus according to a second embodiment of the present invention, the time period for the misfire process is arithmetically predicted by monitoring or detecting the engine rotation number Re immediately after the start of the misfire process and a lowering rate of the engine rotation number Re.

More specifically, the ignition control unit 10A is so programmed or designed to monitor the engine rotation number Re over only a very short time span immediately following the start of the misfire control and arithmetically determine the timer period TM taken for the engine rotation number (rpm) to decrease to the predetermined engine rotation number ReW on the basis of the engine rotation number Re and the lowering rate of the engine rotation speed (rpm) by referencing corresponding map data.

By virtue of the arrangement of the reverse rotation control apparatus according to the second embodiment of the invention, influential factors due to variations of operation performance among the individual engines 1 can be excluded. Thus, the engine rotation number Re can be decreased to the predetermined engine rotation number ReW at the end of the timer period TM with high reliability.

Many modifications and variations of the present invention are possible in the light of the above techniques. It is therefore to be understood that within the scope of the appended claims, the invention may be practiced otherwise than as specifically described.

What is claimed is:

1. A reverse rotation control apparatus for a two-cycle engine mounted on a motor vehicle and driven in two cycles, comprising:

a variety of sensors for generating a variety of information signals in correspondence to engine operating states; and an ignition control unit for generating an ignition signal for said engine on the basis of said variety of information signals, wherein said variety of sensors include a rotation sensor for generating a rotation signal corresponding to rotation number of said engine and a reverse rotation switch for generating a reverse rotation command signal commanding changing over of engine rotation to a reverse rotation, said ignition control unit including:

timer period arithmetic means for arithmetically determining on the basis of said engine operating state a timer period over which misfiring is caused to occur successively in response to inputting of said reverse rotation command signal;

misfire control means for causing misfire events to occur successively over said timer period; and overadvanced ignition signal generating means for outputting only once an ignition signal at a timing overadvanced relative to an ordinary advanced ignition timing upon termination of said timer period;

wherein said timer period represents a time taken for said engine rotation number to lower to a predetermined engine rotation number suited for effectuating engine rotation reversing control due to occurrence of said misfire events, and wherein said predetermined rotation number is set at a value smaller than an idling rotation number of said engine.

2. A reverse rotation control apparatus for a two-cycle engine of a motor vehicle according to claim 1, wherein said ignition control unit further includes:

reverse rotation condition decision means for making decision upon inputting of said reverse rotation command signal as to whether or not said engine operating state satisfies reverse rotation enabling conditions, and wherein operation of said misfire control means is started only when said reverse rotation enabling conditions are satisfied.

3. A reverse rotation control apparatus for a two-cycle engine of a motor vehicle according to claim 2, wherein said various sensors further includes:

a brake switch for generating a brake signal upon braking operation; and an idle switch for generating an idle signal when an acceleration pedal is released, and wherein said reverse rotation enabling condition decision means determines that said reverse rotation enabling conditions are met when said engine rotation number corresponds to an idling rotation number and when both of said brake signal and said idle signal are inputted.

4. A reverse rotation control apparatus for a two-cycle engine of a motor vehicle according to claim 1, wherein said various sensors further includes:

a temperature sensor for outputting a signal indicating temperature information concerning temperature of said engine, and wherein said timer period arithmetic means determines arithmetically said timer period on the basis of said rotation signal and said temperature information.

5. A reverse rotation control apparatus for a two-cycle engine of a motor vehicle according to claim 1, wherein said timer period arithmetic means is so designed as to determine arithmetically said timer period on the basis of the rotation number of said engine prevailing at a time point when said misfire control means is activated and a lowering rate of said rotation number over a time span immediately following activation of said misfire control means.

6. A reverse rotation control apparatus for a two-cycle engine of a motor vehicle according to claim 1, wherein said ignition control unit further includes:

ordinary ignition means for outputting an ordinary ignition signal in succession to an overadvanced ignition signal generated by said overadvanced ignition signal generating means;

reverse rotation decision means for deciding whether or not said engine is in a reverse rotation state at a time point when said normal ignition signal is outputted; and reverse rotation repeating means for executing repetitively reverse rotation control processing for said engine until said reverse rotation state is decided.

7. A reverse rotation control apparatus for a two-cycle engine of a motor vehicle according to claim 6, wherein said reverse rotation repeating means includes counter means for counting a number of times said reverse rotation control processing is repeated, wherein said reverse rotation control processing is terminated at a time point when said repeating number has attained a predetermined rotation number.

8. A reverse rotation control apparatus for a two-cycle engine of a motor vehicle according to claim 1, further comprising:

a normal rotation indicating lamp; and a reverse rotation indicating lamp, wherein said both lamps are driven under the control of said ignition control unit such that said normal rotation indicating lamp is energized only when said engine is rotating in the normal direction, while said reverse rotation indicating lamp is lit only when said engine is rotating in the reverse direction.

* * * * *

UNITED STATES PATENT AND TRADEMARK OFFICE

CERTIFICATE OF CORRECTION

PATENT NO. : 6,039,010
DATED : March 21, 2000
INVENTOR(S) : Toshiaki Hatai

It is certified that error appears in the above-identified patent and that said Letters Patent is hereby corrected as shown below:

Title page.
Item [45] should read: -- Date of Patent: *April 4, 2000--
after [73] insert 0 -- [*] Notice: This patent is subject to a terminal disclaimer. --

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*